United States Patent [19]

Hines

[11] Patent Number: 4,612,496

[45] Date of Patent: Sep. 16, 1986

[54] LINEAR VOLTAGE-TO-CURRENT CONVERTER

[75] Inventor: John R. Hines, Garland, Tex.

[73] Assignee: Motorola, Inc., Schaumburg, Ill.

[21] Appl. No.: 656,204

[22] Filed: Oct. 1, 1984

[51] Int. Cl.[4] ..... G05F 3/26

[52] U.S. Cl. ..... 323/315; 330/288

[58] Field of Search ..... 323/311, 312, 314–316; 330/288; 307/260

[56] References Cited

U.S. PATENT DOCUMENTS

| | | | |
|---|---|---|---|
| 4,217,539 | 8/1980 | Okada | 323/316 |
| 4,278,946 | 7/1981 | Kaplan | 330/288 |
| 4,329,639 | 5/1982 | Davis | 323/315 |
| 4,339,669 | 7/1982 | Jarrett et al. | 307/228 |
| 4,354,122 | 10/1982 | Embree et al. | 323/316 |
| 4,443,753 | 4/1984 | McGlinchey | 323/315 |
| 4,536,702 | 8/1985 | Nagano | 323/316 |

FOREIGN PATENT DOCUMENTS

| | | | |
|---|---|---|---|
| 62908 | 4/1983 | Japan | 323/315 |

*Primary Examiner*—William H. Beha, Jr.
*Attorney, Agent, or Firm*—Lowell W. Gresham

[57] ABSTRACT

A linear voltage-to-current converter which operates entirely from a single power supply, accepts input voltages as low as one diode-drop from ground, and accepts input voltages greater than the power supply voltage is disclosed. Current mirrors sense an input voltage converted to a current through a resistor and reflect the current as one component of the output current. Additional compensation circuits provide a second component of the output current which compensates for nonlinearities.

18 Claims, 3 Drawing Figures

LINEAR VOLTAGE-TO-CURRENT CONVERTER

BACKGROUND OF THE INVENTION

This invention relates generally to voltage-to-current converters. Specifically, the present invention relates to voltage-to-current converters which produce an output current that is linearly related to an input voltage. Moreover, the present invention relates to voltage-to-current converters which are entirely biased from a single power supply.

Prior art circuits fail to provide a common solution to three problems associated with voltage-to-current converters. One problem concerns achieving a linear conversion between a voltage input and a current output. A second problem concerns providing a circuit that operates from only one power source. Providing a converter that can operate over a wide range of input voltages presents the third problem.

Some prior art circuits which provide a linear conversion of voltage to current achieve linearity at a cost of requiring extra power sources or limiting the input voltage range over which the circuit operates. An input voltage is typically applied to one node of a resistor while the other node is connected to a reference potential. Thus, the input voltage is translated into an input current through the resistor and then converted into an output current by other circuitry. If ground represents this reference potential, then a linear conversion is possible. However, an active device such as an operational amplifier or transistor which measures the current in the resistor must be biased from two power sources, rather than a single power source, in order to measure current at a group potential.

Prior art linear voltage-to-current converters may operate from a single power source. These converters typically connect the resistor mentioned above to a reference potential which is above ground and provide additional circuitry which compensates for a resulting non-linearity. The non-linearity occurs because the current through the resistor reflects the difference between the input voltage and the reference potential divided by the resistance of the resistor, rather than the input voltage divided by the resistance of the resistor. Prior art circuits which use this approach limit the range of input voltages over which the circuit will operate because input voltages less than the reference potential cannot be converted. For example, the reference potential in a circuit shown in FIG. 2 of U.S. Pat. No. 4,443,753 entitled "Second Order Temperature Compensated Band Gap Voltage Reference" by Gerald F. McGlinchey, and issued Apr. 17, 1984, represents a voltage that is two diode drops above ground. Such a circuit could not convert input voltages less than the two diode-drops, or approximately 1.4 volts using the typical 0.7 volt diode-drop for silicon devices.

Additionally, prior art single power source, linear, voltage-to-current converters tend to sacrifice some degree of linearity in order to achieve the two diode-drop reference potential. Some circuits attempt to match the voltage drop which appears across the base and emitter nodes of an NPN transistor with the voltage drop which appears across the base and emitter nodes of a PNP transistor. However, the base-emitter voltages of NPN and PNP transistors cannot be precisely matched and can vary up to 0.100 volts or 15% from each other. Accordingly, matching NPN and PNP transistors results in a degradation of linearity in the voltage-to-current converter.

Accordingly, it is an object of the present invention to provide an improved voltage-to-current circuit which may operate entirely from a single power source.

Another object of the present invention relates to providing an accurate linear conversion of input voltage into output current by accurately compensating for any non-linearity which may be a consequence of using only one power source.

Still another object concerns accommodating a wide range of input voltages. The present invention converts input voltages as near to ground as the voltage represented by one diode-drop. Additionally, the present invention converts input voltages significantly greater than the voltage exhibited by the power source.

Yet another object relates to providing an improved voltage-to-current converter which exhibits an adjustable temperature coefficient that may be used to counteract detrimental temperature characteristics of other parts of a system. Alternatively, the temperature coefficient may be adjusted so that it is very low and the voltage-to-current conversion is substantially independent of temperature.

Another object requires the present invention to consume only a minimum amount of power during standby.

SUMMARY OF THE INVENTION

The above and other objects and advantages of the present invention are carried out in one form by a circuit which converts an input voltage into an output current. The output current is linearly related to the input voltage. The input voltage is applied to a first node of a resistor having a predetermined resistance. A current producing means which outputs a current substantially equivalent to a measured current couples to a second node of the resistor. The voltage at the second node of the resistor remains at approximately one diode-drop removed from a common or ground potential. An output current increasing means couples to the current producing means and increases the output current by an amount equivalent to the voltage of one diode-drop divided by the predetermined resistance of the resistor.

BRIEF DESCRIPTION OF THE DRAWINGS

A more complete understanding of the invention and a fuller appreciation of the many advantages thereof will be readily derived by reference to the detailed description and claims when considered in connection with the accompanying drawings, wherein:

DETAILED DESCRIPTION OF THE INVENTION

Figure 1:
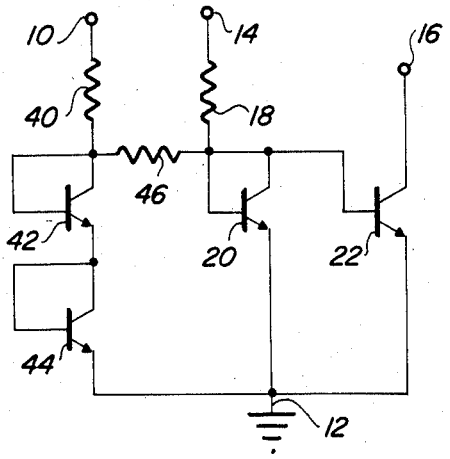
FIG. 1 shows a simplified first embodiment of the present invention.

FIG. 1 shows a first embodiment of the linear voltage-to-current converter of the present invention. In this embodiment a terminal 10 is adapted to have a positive DC voltage applied thereto. A common potential, or ground, is applied to a terminal 12. The positive DC voltage and common potential may be supplied from any power source such as power busses, power supplies, batteries, and the like.

A first node of a first resistor 40 connects to terminal 10. A second node of resistor 40 connects to a first node of a resistor 46, a base of an NPN transistor 42, and a collector of transistor 42. An emitter of transistor 42 connects to a base and a collector of an NPN transistor 44. An emitter of transistor 44 connects to ground 12.

A first node of a resistor 18 is adapted to have an input voltage applied thereto at terminal 14. A scond node of resistor 18 connects to a second node of resistor 46, a collector of an NPN transistor 20, a base of transistor 20, and a base of an NPN transistor 22. An emitter of transistor 20 and an emitter of transistor 22 both connect to ground 12. A collector of transistor 22 connects to a terminal 16 which serves as a current output node of the voltage-to-current converter of this embodiment.

When the bases and the emitters of transistors having similar characteristics are connected together, they form a circuit known in the art as a current mirror. When the transistors which form a current mirror have substantially equivalent geometries, the current flowing in the collector of the input transistor is reproduced or mirrored at the collector of the output transistor. This result is a consequence of both transistors having the same base-emitter voltage. The base-emitter voltages are the same because the bases are connected together and the emitters are connected together.

In this embodiment transistors 20 and 22 form a current mirror. Transistor 20 represents the input transistor and transistor 22 represents the output transistor. Transistors 20 and 22 may advantageously be matched together to insure that they exihibit similar characteristics when a base-emitter voltage is applied to them.

A first component of the current flowing into the collector of transistor 20 comes from resistor 18. This component reflects the input voltage applied to terminal 14. Since the collector of transistor 20 is connected to the base of transistor 20, it remains at a constant voltage represented by the base-emitter voltage of transistor 20, or a constant one diode-drop above ground 12. Accordingly, the magnitude of the first component of current to transistor 20 is represented by the equation:

$$I1=(Vin-Vbe)/R$$

where

I1 = the current of the first component;

Vin = the input voltage referenced to ground 12;

Vbe = a voltage equivalent to one diode-drop; and

R = the resistance of resistor 18.

This first component of current is not linearly related to the input voltage; rather, it is linearly related only to the difference between the input voltage and Vbe.

The current flowing into the collector of transistor 20 additionally contains a second component of current which comes from the second node of resistor 46. Transistors 42 and 44 are connected so that the first node of resistor 46, which connects to the collector of transistor 42, remains at a relatively constant voltage. This constant voltage is represented by the base-emitter voltage of transistor 44 added to the base-emitter voltage of transistor 42, or two diode-drops above a common potential represented by ground 12. Resistor 40 serves to bias transistors 42 and 44. Accordingly, the magnitude of the second component of current is represented by the equation:

$$I2=(2Vbe-Vbe)/R=(Vbe)/R$$

where

I2 = the current of the second component;

Vbe = a voltage equivalent to one diode-drop; and

R = the resistance of resistor 46.

Since the output current at terminal 16 mirrors the input current, and since the input current consists of the first and second components, the output current is represented by the equation:

$$Iout=(Vin-Vbe)/R+Vbe/R=Vin/R$$

where

Iout = the output current at terminal 16;

Vin = the input voltage referenced to ground 12; and

R = the resistance for each of resistors 18 and 46.

and the current in transistors 42 and 44 is approxmately equal to the current in transistor Q22.

Accordingly, it can be seen that the output current at terminal 16 is linearly related to the input voltage. In this embodiment resistor 46 serves to increase the current output at terminal 16 by an amount which compensates for the non-linearity caused by the Vbe term.

This first embodiment of the present invention achieves a voltage-to-current conversion using only a single power source. All components are entirely biased from this single power source. This first embodiment also achieves a linear conversion because circuitry compensates for non-linearities without relying on characteristics of devices which cannot be matched, such as relying on the equivalence of base-emitter voltages between NPN and PNP transistors. Further, this embodiment permits input voltages as low as one diode-drop above ground.

Some applications for the present invention may advantageously use a more sophisticated embodiment which consumes less power than the first embodiment. Accordingly, FIG. 2 shows a second embodiment which achieves this and other objectives.

Figure 2:
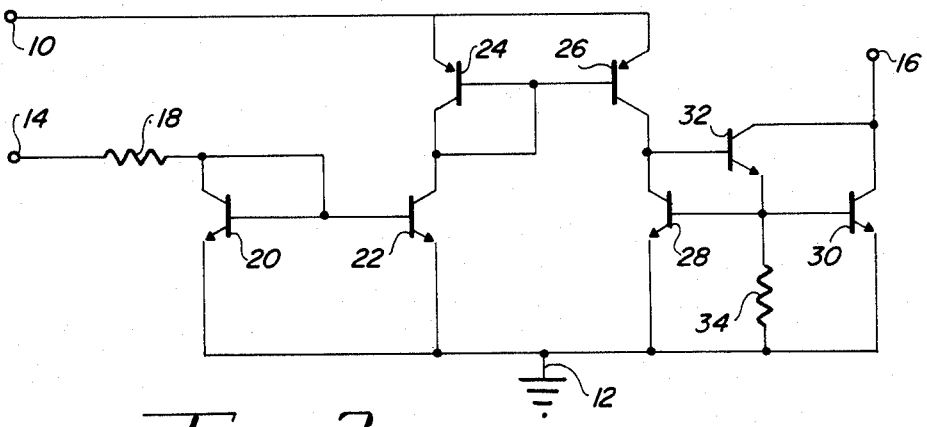
FIG. 2 shows a second embodiment of the present invention having an output that sinks current.

Components in FIG. 2 which have equivalent reference numbers to components in FIG. 1 indicate functions which correspond to those described above in connection with FIG. 1. Thus, terminal 10 is adapted to receive a positive supply voltage and ground 12 is adapted to receive a common potential. Voltage input terminal 14 connects to the first node of resistor 18 and the second node of resistor 18 connects to bases of NPN transistors 20 and 22, and to the collector of transistor 20. The emitters of transistors 20 and 22 both connect to ground 12.

The collector of transistor 22 connects to bases of PNP transistors 24 and 26 and to a collector of transistor 24. Emitters of transistors 24 and 26 both connect to the positive DC voltage applied at terminal 10.

A base of an NPN transistor 32 and a collector of an NPN transistor 28 connect to a collector of transistor 26. An emitter of transistor 32 connects to a base of transistor 28, a base of an NPN transistor 30, and to a first node of a resistor 34. Emitters of transistors 28 and 30 and a second node of resistor 34 connect to ground 12. The terminal 16 serves as the output node for the voltage-to-current converter and connects to collectors of transistors 30 and 32.

This second embodiment of the present invention includes three current mirrors. The current mirror formed by transistors 20 and 22 operates similarly to that described above in connection with the first embodiment. However, no current increasing resistor is provided at this point of the circuit. Thus, the current flowing in the collector of transistor 22 reflects the input voltage at terminal 14 offset by Vbe.

Since transistor 22 is an NPN transistor with its emitter connected to ground 12, it sinks current. Current is supplied to the collector of transistor 22 though the input of a second current mirror formed from transistors 24 and 26. Since transistors 24 and 26 are PNP transistors, the current mirror formed thereby sources current with transistor 24 being the input transistor and transistor 26 being the output transistor. In this embodiment transistors 24 and 26 are matched together and have similar geometries so that the current sourced by the collector of the input transistor 24 is mirrored at the collector of the output transistor 26.

A third current mirror is formed from NPN transistors 28 and 30. In this third current mirror transistor 28 represents the input and transistor 30 represents the output. Since the collector of input transistor 28 connects to the collector of output transistor 26 the same amount of current which was mirrored in the first and second current mirrors is input to the third current mirror, except for a small amount of current which flows into the base of transistor 32.

As is well known in the art, the base current into transistor 32 can be ignored when transistor gain is large. Since sufficiently large gains are common in the manufacture of integrated circuits and in commonly available discrete transistors and matched transistor pairs, this base current is ignored in the analysis of the present invention. Accordingly, essentially the same amount of current which flows in the first and second current mirrors flows in the collector of transistor 30. This current represents a first component of the output current at terminal 16 and reflects the input voltage offset by the base-emitter voltage of transistors 20 and 22.

A second component of the output current at terminal 16 is supplied by transistor 32. This second component increases the output at terminal 16 sufficiently to compensate for the non-linearity caused by the Vbe term, as described above in connection with the first embodiment of FIG. 1. Since resistor 34 is connected between the common base node and ground 12 of the third current mirror, an amount of current equivalent to Vbe/R flows through resistor 34. When the resistance of both resistors 18 and 34 are equal, this current represents the amount needed to compensate for the non-linearity caused by the Vbe terms. Ignoring the current into the bases of transistors 28 and 30 as discussed above, it represents the amount of current supplied by transistor 32. Accordingly, the current output at terminal 16 consists of the sum of the first and second components and represents a linear conversion of the voltage input at terminal 14.

Since output transistor 30 is an NPN transistor with its emitter connected to ground, and since current-increasing transistor 32 is an NPN transistor with its emitter coupled to ground, the output of the voltage-to-current converter of this embodiment has the capability of sinking current.

As discussed above it may be advantageous for the transistors of a current mirror to be matched with each other. However, in the present embodiment no significant deterioration in performance will occur if the transistors of one current mirror are not matched with the transistors that are part of that current mirror. Accordingly, the fact that NPN transistors are usd with PNP transistors does not cause a non-linearity to occur because NPN transistors are matched only with NPN transistors, and PNP transistors are matched only with PNP transistors. Furthermore, there is no requirement for transistor 32 to be matched with transistors 28 and 30.

Figure 3:
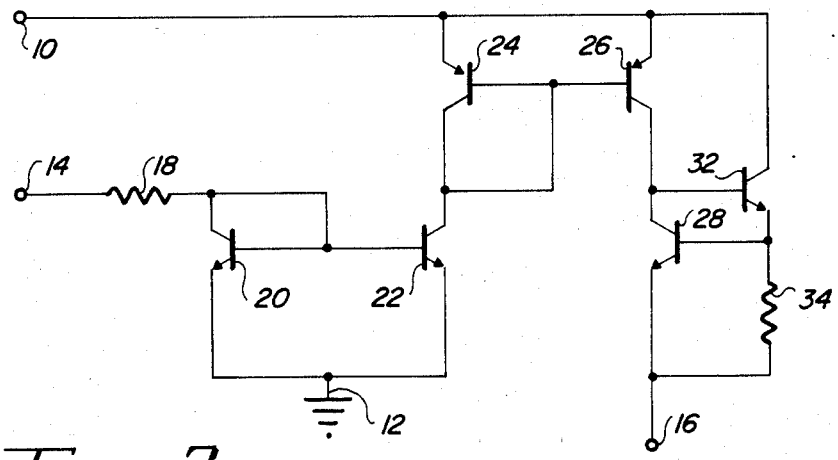
FIG. 3 shows a third embodiment of the present invention having an output that sources current.

FIG. 3 shows a third embodiment of the present invention. The third embodiment is similar to the second embodiment shown in FIG. 2 except that the current output of the third embodiment sources current. Components in FIG. 3 which have equivalent reference numbers to components in FIG. 2 indicate functions which correspond to those described above in connection with FIG. 2.

Thus, in the third embodiment terminal 10 is adapted to have a positive DC voltage applied thereto, and ground 12 references a common potential. Terminal 14 receives an input voltage and connects to the first node of resistor 18. The second node of resistor 18 connects to the bases of NPN transistors 20 and 22 and to the collector of transistor 20. The emitters of transistors 20 and 22 connect to ground 12. The collector of transistor 22 connects to the bases of PNP transistors 24 and 26 and to the collector of transistor 24. The emitters of transistors 24 and 26 connect to terminal 10. The collector of transistor 26 connects to the collector of NPN transistor 28 and to the base of NPN transistor 32. The collector of transistor 32 connects to terminal 10. The emitter of transistor 32 connects to the base of transistor 28 and to the first node of a resistor 34. The second node of resistor 34 connects to the emitter of transistor 28 and to the terminal 16. Terminal 16 serves as the current output node for the voltage-to-current converter.

Transistors 20 and 22 form a first current mirror, and transistors 24 and 26 form a second current mirror, as discussed above in connection with the second embodiment of the present invention. As described above, the current flowing in the output of the current mirror, which occurs at the collector of transistor 26, reflects the input voltage at terminal 14 offset by the base-emitter voltage of transistors 20 and 22. Ignoring the base currents of transistors 32 and 28, this current also flows in the emitter of transistor 28 and comprises a first component of the output current at terminal 16.

The second component of the output current at terminal 16 comes from resistor 34. Resistor 34 connects across the base and emitter nodes of transistor 28. Transistor 32 serves as a current-increasing transistor in that is supplies current to resistor 34. Thus, when the resistance value of resistor 34 equals the resistance value of resistor 18, this second component sufficiently compensates for the non-linearity caused by the base-emitter voltage of transistors 20 and 22.

Since both transistors 28 and 32 exhibit an NPN polarity and the collectors of both are coupled to a positive DC voltage applied at terminal 10, this third embodiment sources current.

The second and third embodiments of the present invention accomplish the object of a low power implementation because all the current drawn from the positive DC voltage applied at terminal 10 is used in the operation of the circuit. No current is wasted through resistor chains which might bias transistors or the like. Furthermore, when an input voltage of less than one diode-drop is applied at terminal 14, a stand-by mode occurs. In the stand-by mode all transistors are in an "off" state where the only current flowing through the transistors is due to leakages.

These second and third embodiments further achieve the objective of allowing a wide range of input voltages. As mentioned above, the present invention permits input voltages as low as one diode-drop above ground. These embodiments also permit input voltages which are greater than the positive DC voltage applied at terminal 10. Only the current limiting capabilities of resistor 18 and the current sinking and sourcing capabilities of the transistors limit the maximum input voltage.

The second and third embodiments also accomplish the object of exhibiting an adjustable temperature coefficient. One of the properties of a current mirror is that temperature changes tend to affect each of the transistors which are included in the current mirror similarly. Thus, the temperature effects tend to cancel one another, and the net result is that the current mirror's performance remains substantially unchanged as temperature changes.

The non-current mirror elements in these embodiments are represented by resistors 18 and 34. Accordingly, the temperature coefficients of resistors 18 and 34 also represent the temperature coefficeint of the voltage-to-current converter. The temperature coefficient represents the amount a particular parameter, such as resistance, voltage, or current, changes in response to a given change in temperature. Thus, using resistors with a very low temperature coefficient produces a voltage-to-current converter with a correspondingly low temperature coefficient. Alternatively, resistors having any known temperature coefficient may be used to cause the voltage-to-current converter to cancel out reciprocal temperature coefficients from other system elements.

A consequence of the temperature characteristics concerns the matching of resistors. As mentioned above, the resistance values of resistors 18 and 34 may advantageously be equivalent to maximize the linearity of the voltage-to-current converter. Likewise, it may be advantageous for the temperature coefficient of resistor 34 to match the temperature coeffieient of resistor 18 so that linearity over temperature may be maximized.

The foregoing description uses various embodiments to illustrate the present invention. However, those skilled in the art will recognize that changes and modifications may be made in these embodiments without departing from the scope of the present invention. For example, the above embodiments have described particular polarities such as positive DC voltages, NPN and PNP transistors, and voltages equivalent to a diode-drop as being above a common potential, or ground. Those skilled in the art will recognize that the present invention may be implemented using negative DC voltages, or PNP and NPN transistors. Likewise, voltages equivalent to a diode-drop might be either greater than or less than ground so that a voltage of one diode-drop from a common potential refers to both a voltage greater than ground and a voltage less than ground. These and other modifications obvious to those skilled in the art are intended to be included in the scope of this invention.

What is claimed is:

1. A method of converting an input voltage into an output current which is linearly related to the input voltage, the method comprising the steps of:

sensing a current produced by the input voltage applied to a resistor having a predetermined resistance and being coupled to a node which remains at a substantially constant voltage approximately one diode-drop from a common potential;

mirroring the sensed current from said sensing step at an output node; and increasing the current at the output node of said mirroring step by an amount substantially equivalent to the voltage of one diode-drop divided by the predetermined resistance of the resistor.

2. A method as claimed in claim 1 additionally comprising the steps of:

using a current mirror to accomplish said mirroring step; and operationally biasing the current mirror by coupling the current mirror between a single power source and a common potential.

3. A linear voltage-to-current converter comprising:

a positive terminal for receiving a positive DC voltage relative to a common potential;

a ground terminal for receiving the common potential;

a first resistor exhibiting a predetermined resistance, having an input which couples to an input voltage, and having an output;

a first NPN transitor having a base, collector and emitter, said first transistor base being coupled to the output of said first resistor and to the collector of said first transistor, and said first transistor emitter being coupled to said ground terminal;

a second NPN transistor having a base, collector and emitter, said second transistor base being coupled to the base of said first transistor, said second transistor emitter being coupled to said ground terminal, and said second transistor being matched with said first transistor;

a third PNP transistor having a base, collector, and emitter, said third transistor base and collector being coupled to said second transistor collector, and said third transistor emitter being coupled to said positive terminal;

a fourth PNP transistor having a base, collector, and emitter, said fourth transistor base being coupled to the base of said third transistor, said fourth transistor emitter being coupled to said positive terminal, and said fourth transistor being matched with said third transistor;

a fifth NPN transistor having a base, collector, and emitter, and fifth transistor collector being coupled to the collector of said fourth transistor;

a sixth NPN transistor having a base, collector, and emitter, said sixth transistor base being coupled to the collector of said fourth transistor, and the emitter of said sixth transistor being coupled to the base of said fifth transistor; and a second resistor exhibiting a resistance substantially equivalent to the predetermined resistance of said first resistor and being coupled between the base and emitter of said fifth transistor.

4. A voltage-to-current converter as claimed in claim 3 wherein the collector of said sixth transistor couples to said positive terminal, and the emitter of said fifth transistor provides output current for the converter.

5. A linear voltage-to-current converter comprising:

an output node adapted to provide a current output from the converter;

means coupled to said output node for producing a current substantially equivalent to a sensed current, the sensed current being at a voltage substantially equivalent to one diode-drop from a common potential;

a first resistor having a predetermined resistance, said first resistor being coupled to said current producing means and being adapted to receive an input voltage referenced to the common potential; and a second resistor coupled to said current producing means so that the current at said output node increases by an amount substantially equivalent to the voltage represented by one diode-drop divided by the predetermined resistance of said first resistor.

6. A voltage-to-current converter as claimed in claim 5 wherein said current producing means sinks the output current.

7. A voltage-to-current converter as claimed in claim 6 wherein said current producing means comprises a first current mirror having an input coupled to said first resistor and having an output.

8. A voltage-to-current converter as claimed in claim 7 wherein said current producing means additionally comprises:

a second current mirror having an input coupled to the output of said first current mirror and having an output; and a third current mirror having an input coupled to the output from said second current mirror and having an output coupled to said output node.

9. A voltage-to-current converter as claimed in claim 8 wherein said third current mirror has a common base node, and the voltage-to-current converter additionally comprises:

a current-increasing transistor having a base coupled to the output of said second current mirror, having a collector coupled to the output of said third current mirror, and having an emitter coupled to the common base node of said third current mirror, wherein said second resistor has a resistance substantially equivalent to the predetermined resistance of said first resistor, and said second resistor is coupled between the common base node of said third current mirror and a terminal adapted to receive the common potential.

10. A voltage-to-current converter as claimed in claim 9 wherein said first and second resistors exhibit substantially equivalent temperature coefficients.

11. A voltage-to-current converter as claimed in claim 9 wherein said third current mirror is comprised of matched transistors.

12. A voltage-to-current converter as claimed in claim 11 wherein said first and third current mirrors are comprised of NPN transistors and said second current mirror is comprised of PNP transistors.

13. A voltage-to-current converter as claimed in claim 5 wherein said current producing means sources current.

14. A voltage-to-current converter as claimed in claim 13 wherein said current producing means comprises a first current mirror having an input coupled to said first resistor and having an output.

15. A voltage-to-current converter as claimed in claim 14 wherein said current producing means additionally comprises:

a second current mirror having an input coupled to the output of said first current mirror and having an output; and a first transistor having a collector, an emitter, and a base, the collector coupled to the output of said second current mirror.

16. A voltage-to-current converter as claimed in claim 11 additionally comprising:

a current-increasing transistor having a base coupled to the output of said second current mirror, having a collector coupled to the emitter of said first transistor, and having an emitter coupled to the base of said first transistor, wherein said second resistor has a resistance substantially equivalent to the predetermined resistance of said first resistor, and said resistor is coupled between the base and emitter of said first transistor.

17. A voltage-to-current converter as claimed in claim 16 wherein said first and second resistors exhibit substantiallly equivalent temperature coefficients.

18. A voltage-to-current converter as claimed in claim 16 wherein said first current mirror, said first transistor, and said increasing transistor are comprised of NPN transistors and said second current mirror is comprised of PNP transistors.

* * * * *

UNITED STATES PATENT AND TRADEMARK OFFICE

CERTIFICATE OF CORRECTION

PATENT NO. : 4,612,496

DATED : September 16, 1986

INVENTOR(S) : John R. Hines

It is certified that error appears in the above-identified patent and that said Letters Patent is hereby corrected as shown below:

In claim 16, second line of the claim, delete "11" and insert therefor --15--.

Signed and Sealed this

Seventeenth Day of March, 1987

*Attest:*

DONALD J. QUIGG

*Attesting Officer*

*Commissioner of Patents and Trademarks*